US005823214A

United States Patent [19]

Seidel

[11] Patent Number: 5,823,214

[45] Date of Patent: Oct. 20, 1998

[54] SELF OPENING AND SELF CLOSING COLLAPSIBLE UMBRELLA

[75] Inventor: Joachim Seidel, Solingen, Germany

[73] Assignee: Kortenbach Verwaltungs- und Beteiligungsges. mbH & Co., Solingen, Germany

[21] Appl. No.: 888,729

[22] Filed: Jul. 7, 1997

[30] Foreign Application Priority Data

Sep. 10, 1996 [DE] Germany ..... 196 36 690.9

[51] Int. Cl.[6] ..... A45B 25/14

[52] U.S. Cl. ..... 135/22; 135/24; 135/38; 135/41

[58] Field of Search ..... 135/22, 24, 20.3, 135/25.1, 25.3, 25.4, 25.41, 28, 31, 37, 38, 39, 41

[56] References Cited

U.S. PATENT DOCUMENTS

| | | | |
|---|---|---|---|
| 4,941,494 | 7/1990 | Wu | 135/24 X |
| 5,078,165 | 1/1992 | Wu . | |
| 5,178,174 | 1/1993 | Wu . | |
| 5,267,583 | 12/1993 | Wu . | |
| 5,390,686 | 2/1995 | Lin et al. . | |
| 5,441,065 | 8/1995 | Lin et al. . | |
| 5,492,140 | 2/1996 | Lin et al. | 135/24 |
| 5,505,222 | 4/1996 | Lin et al. . | |
| 5,617,889 | 4/1997 | Wu . | |
| 5,626,160 | 5/1997 | Ko . | |
| 5,626,161 | 5/1997 | Lin et al. . | |

*Primary Examiner*—Lanna Mai
*Attorney, Agent, or Firm*—Henry M. Feiereisen

[57] ABSTRACT

An automatic umbrella of the collapsible pocket type includes a handle accommodating a first release mechanism (A1) for the opening operation and a second release mechanism (A2) for the closing operation, a control button (11) arranged in the umbrella handle (12) for staggered actuation of the release mechanisms (A1, A2), a telescopically shortenable umbrella stick (1) with an umbrella crown (4), a runner (5) traveling along the umbrella stick (1) and a canopy rib assembly (2) formed by canopy rib units (2°), a first spring mechanism (F1) arranged in the umbrella stick (1) for opening the umbrella by extending the umbrella stick (1), a second spring mechanism (F2) integrated in the canopy rib units (20) and tensioned during opening operation for effecting a closing of the umbrella, a tackle (S) including a rope (S') which engages the runner (5) and cooperates with the release mechanism (A2) via a rod (8) mounted slidably in the umbrella stick (1) and a first catch (9) arranged thereon and formed with a hooked end engageable on a locking member (10). The second release mechanism (A2) includes a release slider (14, 15) cooperating with the first catch (9) and slidably guided within in the stick, and a locking catch (16) slidable synchronously with the release slider (14, 15) and cooperating with the control button (11), with this slidable assembly (14, 15, 16) as a function of retraction and extension of the umbrella stick (1) moving alternately into the position ready for release relative to the first catch (9) and the control button (11) in a direction towards first catch (9), and moves away from the first catch (9) into a neutral position.

17 Claims, 8 Drawing Sheets

SELF OPENING AND SELF CLOSING COLLAPSIBLE UMBRELLA

BACKGROUND OF THE INVENTION

The present invention refers generally to an automatically opening and closing umbrella that is collapsible to pocket size. More specifically, the present invention is directed to an automatic umbrella of a type having a handle, a canopy assembly, a telescopically shortenable stick extending between the handle and the canopy assembly, with the handle accommodating a first release mechanism for the opening operation of the umbrella via a compression spring arranged in the stick and a second release mechanism for the closing operation of the umbrella via tension springs integrated in the canopy assembly and tensioned during the opening operation, a control button in the form of a push button arranged in the handle for actuation of the first and second release mechanisms, a runner which travels along the stick, and a tackle which engages the runner and cooperates with the second release mechanism via a rod mounted slidably in the stick and carrying a catch which has a hooked end for engaging a locking member.

An umbrella of this type is described for example in U.S. Pat. No. 5,492,140. While such an umbrella is particularly easy to operate, as both opening and closing operations proceed automatically by simply pressing the push button, the overall structure is very complex and expensive with respect to manufacture of the release mechanisms necessary for effecting the automatic opening and closing operations including release and unlocking systems which have to be coordinated to one another. These mechanisms in conventional automatic umbrellas of the opening and closing type are very complicated and installed in close relationship essentially in and around the umbrella stick so that their assembly is difficult. Moreover, they are difficult to access or not accessible at all if repair works become necessary. Apart from these drawbacks, these conventional umbrellas display also a certain functional weakness, in particular of the locking and unlocking mechanism associated with the closing operation, because these mechanisms are installed in miniaturized form within the very tight space in and around the umbrella stick and are subject to considerable spring pressure, but also because fixation and release of the tensioned telescopic stick take place exclusively between the umbrella stick and the handle, and the catch which secures the tackle in the locking member on the stick side is an inherently rigid member, while the locking member is a transversely movable catch element.

SUMMARY OF THE INVENTION

It is thus an object of the present invention to provide an improved automatic collapsible umbrella, obviating the afore-stated drawbacks.

In particular, it is an object of the present invention to provide an improved automatic collapsible umbrella which allows locking and unlocking of the tackle in a more reliable manner, effects a more disaggregated arrangement of the components for release and unlocking of the opening and closing release mechanisms and can be so arranged and constructed as to permit a more stress-resistant configuration and easier assembly and disassembly.

These objects and others which will become apparent hereinafter are attained in accordance with the present invention by forming the second release mechanism with a release member slidably received in the stick for interaction with the first catch, and a second locking catch slidable synchronously with the release slider and cooperating with the control button, whereby this slidable assembly moves alternately in dependence of retraction and extension of the umbrella stick into a position ready for release with respect to the catch and the control button in a direction towards the catch, and away from the catch into a neutral position.

This results in a considerable improvement of an automatically opening and closing umbrella, both structurally and in operation, with regard to manufacture and operational reliability as well as capability for assembly and disassembly. As a consequence of the arrangement and sliding of the unlocking mechanism and second release mechanism centrally and parallel to the stick and their corresponding coupling and uncoupling in and out of their working positions by means of the control button and the catch and its hooked end, the overall structure is substantially disaggregated and thus leads to a stronger, more stable configuration of the mechanisms for effecting opening and closing of the umbrella, unlike the extremely unfavorable cramped arrangement in the cavity of the stick in conventional umbrellas. Only the catch and its unlocking system of the closing mechanism remains in the stick. The locking and unlocking system of the opening mechanism is separated from the closing mechanism and installed in the more spacious area away from the umbrella stick, with the slidable control button assuming a dual function as trigger member for initiating the opening and closing operations as well as control slider or coupling element for continuously coupling and uncoupling of the catch and its hooked end. The closing and opening mechanics consequently functions in a disaggregation of two groups which are separate from one another as far as arrangement and operation are concerned and which can be coupled to and disengaged from one another in the continuous functional sequence of opening, closing and stick-shortening operations. Hence, all the components can be made more resistant to stress and more reliable in operation and can be easily assembled and, if necessary, easily replaced.

According to a preferred embodiment of the present invention, the control button is guided slidably in the handle, with the locking member for receiving and locking the hooked end of the first catch being formed of tubular configuration and fitted in a cavity coaxially to the umbrella stick axis and supported by the umbrella stick, wherein the second release mechanism is united with the release slider and the locking catch to form a structural unit, with the release slider being guided in the cavity and biased by a spring in a direction towards the hooked end of the first catch and, when the umbrella is closed and shortened, being supported on the runner by a stop formed on a lateral arm. The locking catch is swingably mounted to the lateral arm for pivoting about an axis and constructed as a bidirectional lever having a first lever arm provided for engagement of the control button in the closing operation and a second lever arm formed with a hooked end for engagement with the release slider at a distance from the hooked end of the first catch so that during opening process the first release mechanism releases the umbrella stick through actuation of the control button, with the end face of the release slider being held by the hooked end of the second lever arm at a distance to the hooked end of the first catch while the first lever arm enters the travel path of the control button. A subsequent actuation of the control button for initiating the closing operation disengages the hooked end of the second lever arm to allow the release slider to engage the hooked end of the first catch, thereby separating the first catch from the locking member. Upon shortening the umbrella stick, with the tension springs being in a relieved state, the compression spring is tensioned and the hooked end of the first catch hooks on the locking member again.

Thus, a particularly advantageous embodiment of the invention in connection with the first release mechanism results from the fact that this release mechanism cooperates with the runner.

Advantageously, the hooked end of the lever of the second release mechanism cooperates with a stop which is formed on the underside of a holding bush connected to the umbrella handle and encompassing the umbrella stick.

According to another feature of the present invention, the tackle is particularly reliable in operation when the rope is directly secured to the runner or guided over a pulley on the runner and connected to the umbrella crown.

According to another feature of the present invention, the first catch is mounted at radial spring play on a U-shaped hollow section mounted to or formed integrally on a rod, mounted slidably in the stick and carrying the first catch, and the locking member is constructed as a bush inserted in the stick end and formed with a stop ring disposed centrally in the stick for engagement by the hooked end of the first catch. This configuration provides a tackle locking and unlocking system which is particularly resistant to stress and reliable in operation.

Advantageously, the hollow section enters during locking of the first catch with a pointed end through an entrance hole of the locking member and is supported therein on a slope that complements the pointed end for support thereof as soon as the hooked end of the first catch hooks behind the stop ring.

According to yet another feature of the present invention, the release slider is formed by a piston slidable in the cavity of the locking member, and a hollow cylinder attached to the piston and facing the hooked end of the first catch. This results in a particularly stable arrangement and construction of the unlocking mechanism of the tackle which is simple and easy to assemble and disassemble.

According to another advantageous feature, the second release mechanism can be constructed as a structural unit in a rational and functionally favorable manner by guiding the piston within a slot of a transverse pin fixed to the handle and supporting its end facing away from the hollow cylinder on the bottom of the umbrella handle by means of a plate-shaped disk and a compression spring disposed between the handle bottom and the disk, with the arm which extends upwardly in a cavity of the umbrella handle being mounted to the disk.

A full extension of the telescopic stick or longer stick extension strokes can be attained at a fixed transmission ratio of the tackle, and a desired compensation of length tolerances within and between the opening and closing mechanisms can be effected by providing in the tackle a tension compensating device in the form of a spring piston and cylinder arrangement, with a sleeve forming the cylinder and a spring-biased piston bush being guided therein.

Preferably, the tension compensating device is positioned adjacent the pulley on the crown within the umbrella stick between the rope and the rod when the umbrella is closed and shortened. This results in an advantageous disposition of the tension compensating device in conjunction with a locking of the tackle in the locking member.

According to another feature of the present invention, the bottom of the umbrella handle is formed by a cover detachably secured to the handle shaft by a clip connection, and a cylindrical cavity formed between the cover and the handle/stock holding bush serves as a clearance for arranging and sliding the plate-shaped disk and its compression spring. This results in a particularly easy access to the components located in the umbrella handle and easy installation and dismantling thereof.

Advantageously, the transverse pin also uniformly connects the umbrella stick to the locking member and the umbrella handle to simplify installation and dismantling of the components in the umbrella stick and umbrella.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
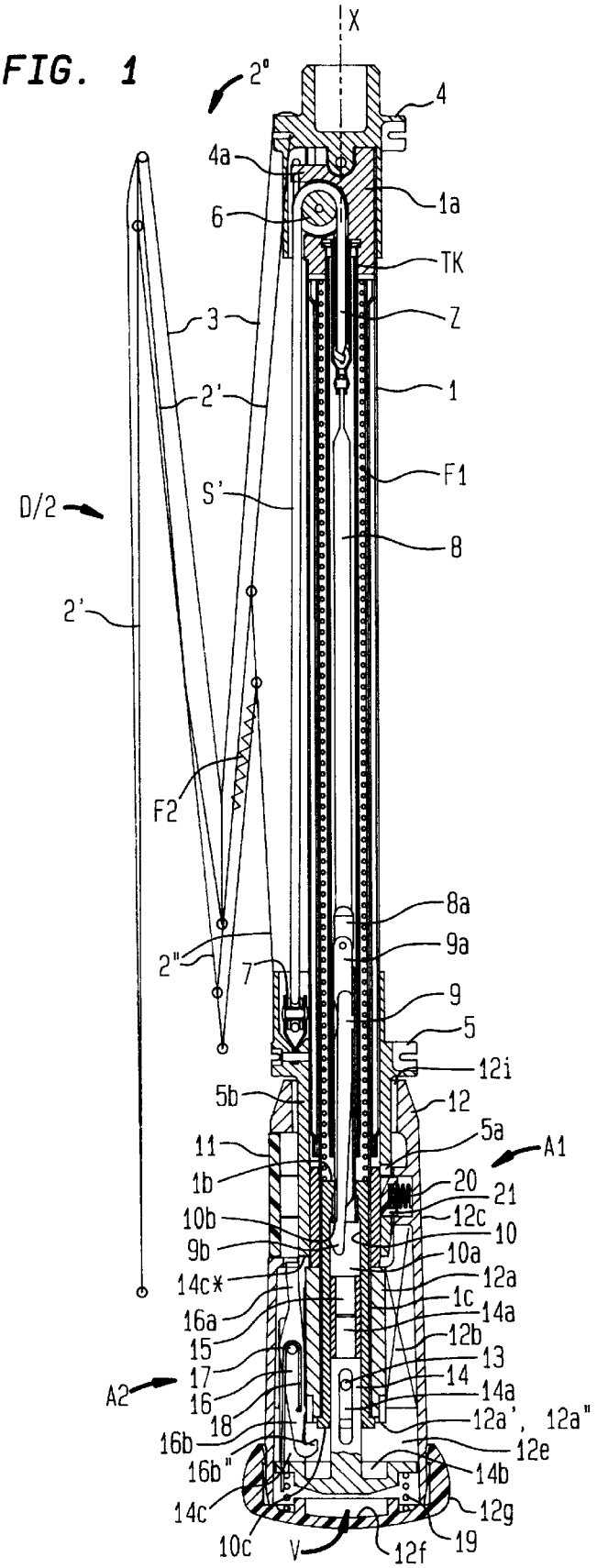
FIG. 1 shows a longitudinal sectional view of one embodiment of an umbrella according to the invention in the closed state shortened to pocket size, illustrating only one canopy rib assembly.

Throughout all the Figures, the same or corresponding elements are generally indicated by the same reference numerals.

Turning now to the drawing, and in particular to FIG. 1, there is shown an automatically opening and closing umbrella having a telescopically shortenable stick 1, defining a longitudinal axis X, and a collapsible canopy D so that it can be kept in the closed state in pocket size. The canopy D supported by a canopy rib assembly 2 and provided with a covering 3 has several rod units 2° C. which in a star-like arrangement around the stick 1 are each pivotably mounted to a crown 4, mounted at the upper end 1*a* of the stick, and to a runner 5 which travels along the stick 1. Each of the rod units 2° C. (only one of which is shown in the drawings for sake of simplicity) includes a suitable jointed combination of canopy ribs 2' and stays 2". One end of the stays 2" is articulated to the runner 5 so that the canopy D can be opened by an upward movement of the runner 5 and closed by a downward movement, by means of an opening spring mechanism F1 and a closing spring mechanism F2. The opening spring mechanism F1 includes a helical compression spring for automatically telescopically extending the stick 1 and opening of the canopy D, and the spring mechanism F2 is provided for automatically closing the canopy D and includes a plurality of tension springs so installed in and biasing the rod units 20 that the rod units 20 seek a collapse of the canopy rod assembly, whereby the spring force of the tension springs F2 is so dimensioned as to be small compared to the spring force of the compression spring F1 for extending the stick 1 and for opening the canopy D.

Figures 5, 6:
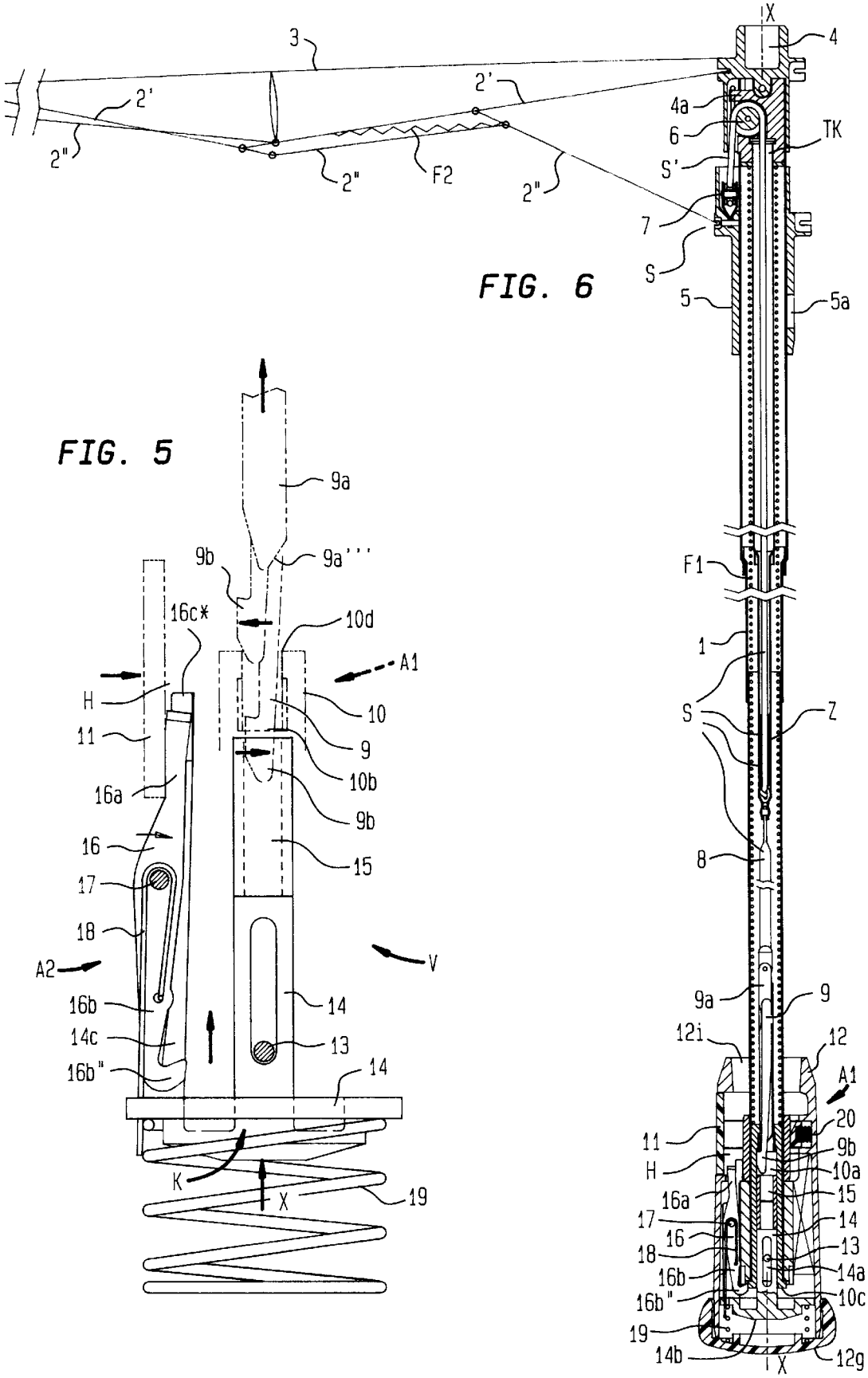
FIG. 5 shows a cutaway view, on an enlarged scale, of the structural and sliding unit together with the release and unlocking system associated with the closing process, in the release or unlocking position.
FIG. 6 shows a longitudinal section of the open umbrella with a single canopy rod assembly.
Figure 7:
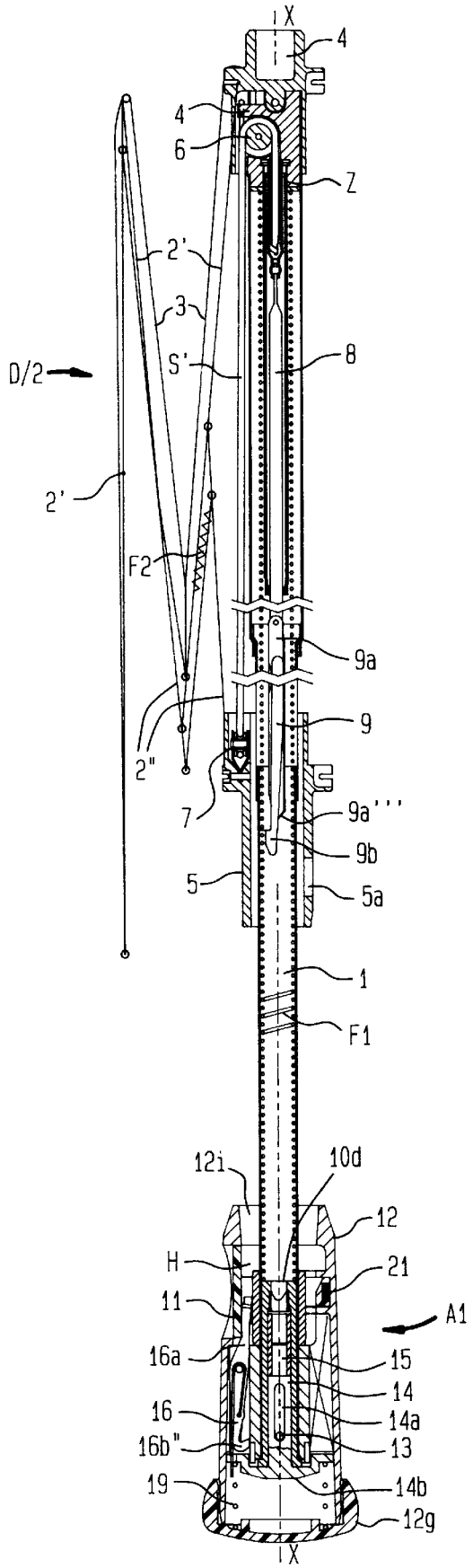
FIG. 7 shows a longitudinal section of the closed umbrella with a single canopy rod assembly.
Figure 9:
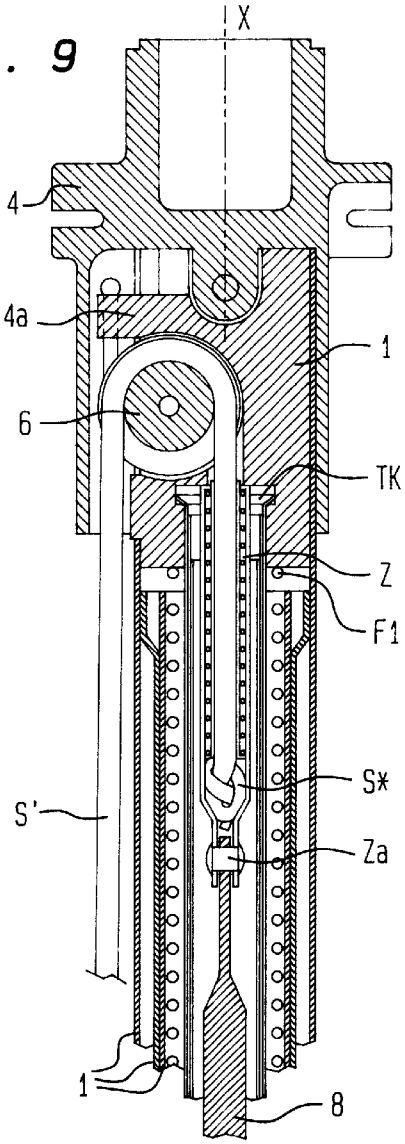
FIG. 9 shows an enlarged portion of the upper end of the umbrella in the functional state of the umbrella according to FIG. 1.

The compression spring F1 extends in the stick 1 between the crown 4 and a stop 1*b* formed within the stick and has a tendency to expand. In order to use this resistance to compression for opening the canopy D, a tackle S is incorporated between the stick 1 and the runner 5 that actuates the canopy D. This type of force-saving transmission is preferably formed as a double-pulley system, with a rope S' running about a pulley 6 on the crown 4 and a pulley 7 on the runner 5. The rope S' has one end fixed to a lug 4*a* on the crown 4 and another end connected directly or via a tension compensation device Z to a push rod 8 which is slidable in the stick 1. Secured to the free end 8*a* of the push rod 8 or a hollow U-section 9*a* formed integrally with or connected to the end 8*a* is a bar in the form of a radial spring catch 9 which has a hooked end 9*b* and is embedded within the hollow section 9*a* so that the catch 9 with the hooked end 9*b* can spring out of this hollow section 9*a* in swinging relationship and also swing back again towards the bottom 9*a'* of the section 9*a*, with a lateral guidance being effected by arms 9*a"* of the section 9*a* (FIG. 5).

Figure 2:
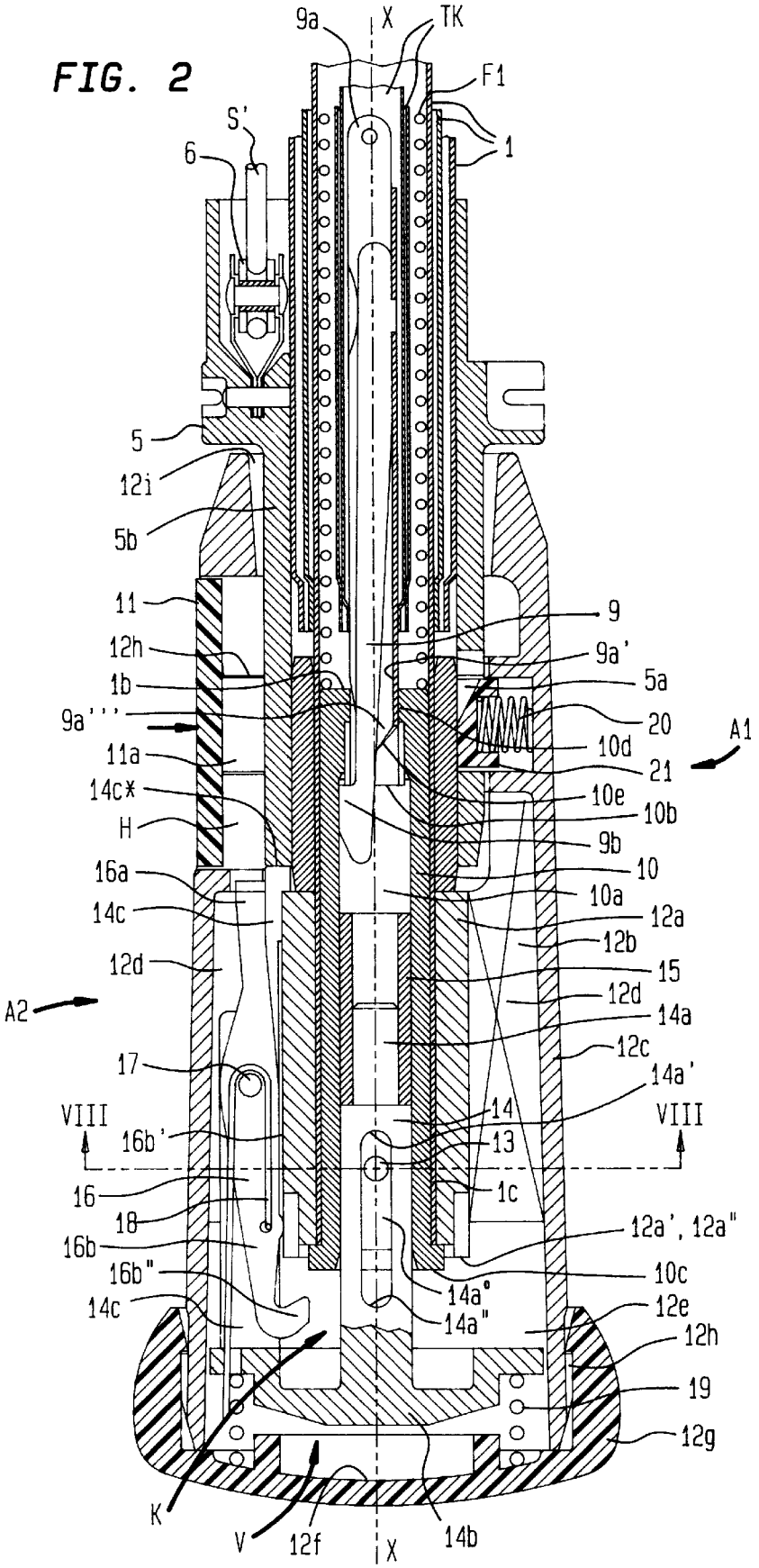
FIG. 2 shows a longitudinal sectional view of the handle region of the umbrella in the functional state of FIG. 1.
Figure 3:
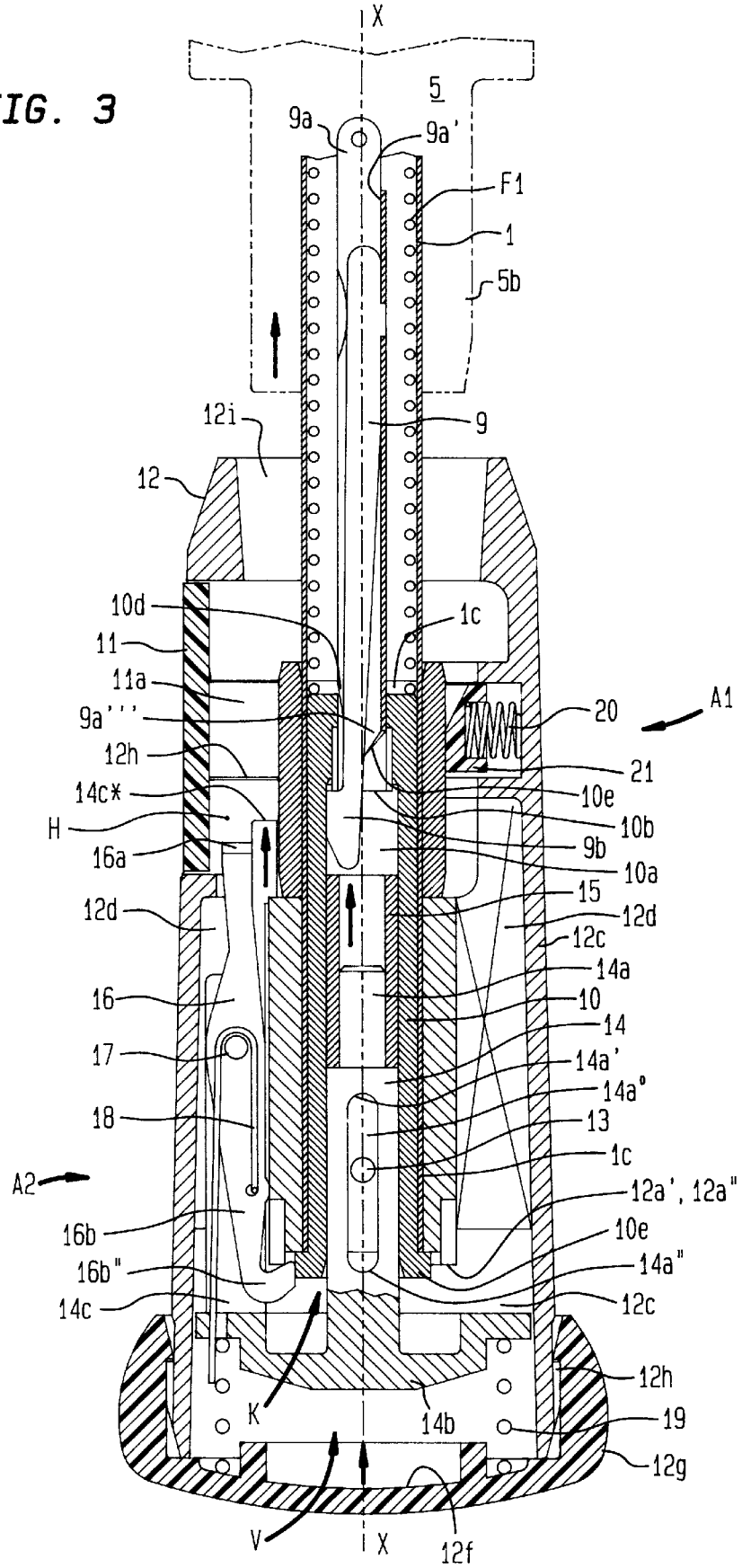
FIG. 3 shows an enlarged longitudinal sectional view of the handle region in the functional state after the opening process has just been triggered.

The catch 9 cooperates with an inherently "rigid" bush-like locking member 10 of a release mechanism, generally denoted by reference character $A^2$ for effecting a closing operation of the umbrella. As shown in FIGS. 1 and 2, the catch 9 hooks with its hooked end 9*b* behind a ring shoulder 10*b* within a cavity 10*a* of the locking member 10 when the umbrella is closed and the stick 1 is shortened. The locking member 10 is received in the stick end 1*c* and fixed in place by a flange 10*c* which bears upon the stick end 1*c*. Thus, the catch 9 is not a rigid bar which is engaged and locked by a radially movable or flexible locking member, but a kind of spring harpoon which is itself anchored in the "rigid" locking member 10. In order to effect a secure sliding of the resilient catch 9 into a precise centered self-latching position with respect to the rigid locking member 10, the hollow U-section 9*a* which accommodates the catch 9 is formed with a pointed end 9*a'"*, as shown in FIGS. 2 and 3, by which, on latching of the catch 9 onto the locking member 10, the U-section 9*a* enters through an entrance hole 10*d* of the locking member 10 and is secured therein along a complementary slope 10*e* until the hooked end 9*b* of the catch 9 travels past the hole 10*d* and latches behind the ring shoulder 10*b*. In this way the tackle S between its fixed points 4, 4*a* and 9*b*, 10*b* in the collapsed shortened state (FIGS. 1, 2) of the umbrella is a stick telescope 1' under spring tension. The tackle S can, as far as it is embedded and movable in the stick 1, be surrounded by the compression spring of the opening spring mechanism F1 which is also located in the stick 1, with a telescoping envelope TK that complements the telescopic stick 1 with respect to length, extension and retraction thereof so as to avoid an undesirable frictional engagement with the compression spring F1. Furthermore, the tension compensation device Z can suitably be so placed in coordination with the push rod 8 as to position itself in the collapsed stick 1 between the push rod 8 and the crown-proximate pulley 6. The tension compensation device Z allows a bridging of dimensional tolerances in the structure of the stick 1 and the canopy kinematics connected therewith, but in particular also allows the stick 1, when the canopy D is open and the stick 1 is extended, to be extended to its full length (FIGS. 6, 11.).

Figure 10:
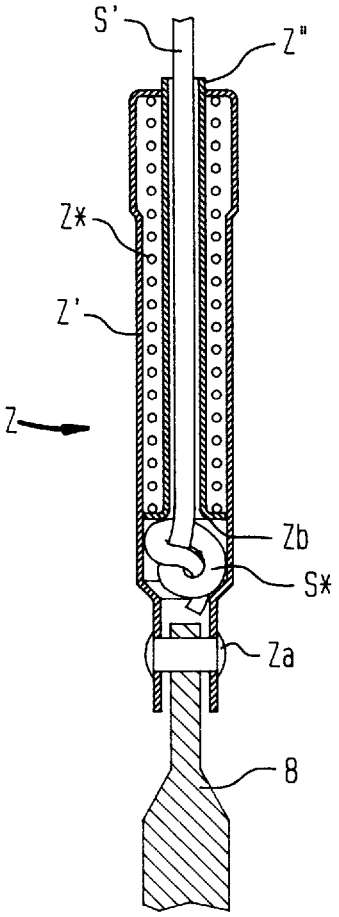
FIG. 10 shows an enlarged longitudinal section of a tension compensating device provided for the tackle in the functional state of FIG. 1.
Figure 11:
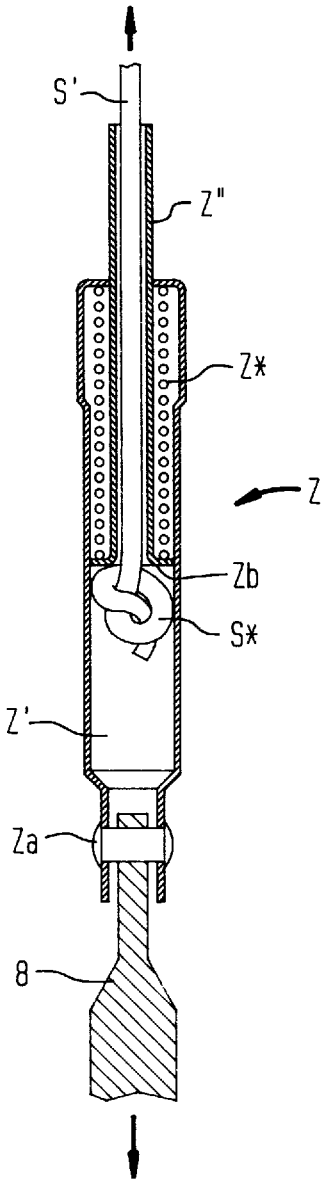
FIG. 11 shows an enlarged longitudinal section of the tension compensating device in the functional state of FIG. 6.

The tension compensation device Z includes a cylinder and piston guidance, with a sleeve Z' forming the cylinder, a piston bush Z" guided therein and a compression spring Z* which resiliently supports the piston bush Z" relative to the sleeve Z', wherein the sleeve Z' engages the push rod 8 by means of a rivet Z*a*, while the piston bush Z" is connected to the rope S' by threading the rope S' through the bush Z" and forming a knot S* which bears against a flange Z*b* of the bush Z" under spring load (FIGS. 10,11).

Figure 8:
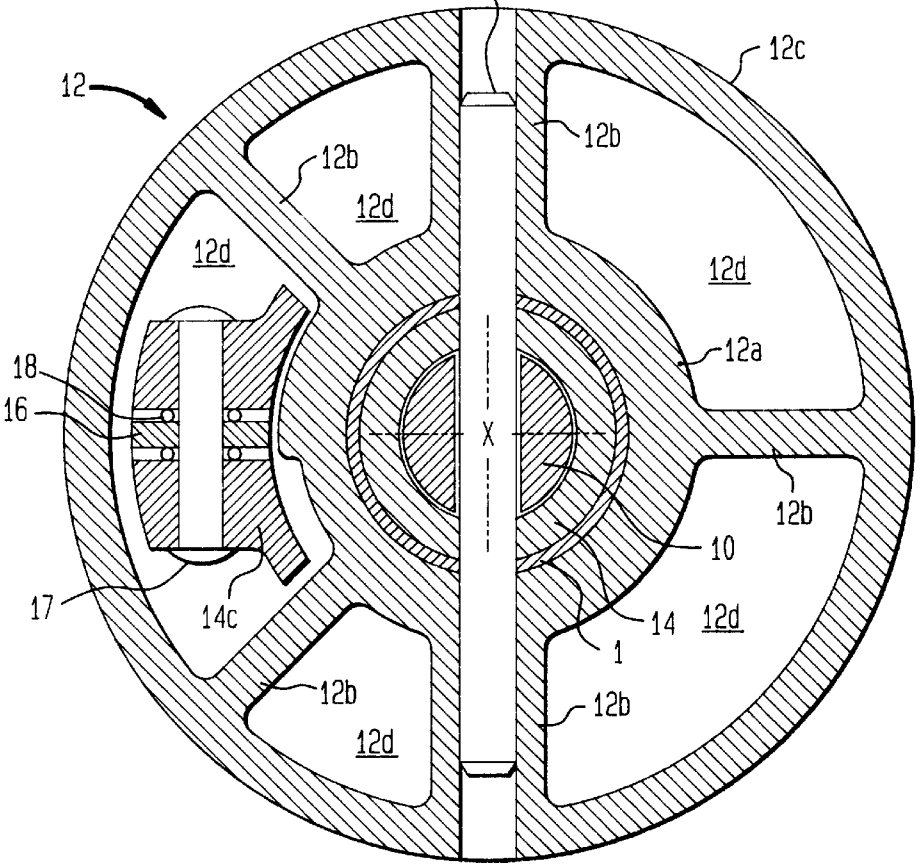
FIG. 8 shows an enlarged cross-section through the umbrella handle in the region at its attachment to the stick, taken along the line VIII—VIII in FIG. 2.

The handle 12 has a central holding bush 12*a* having integrally formed thereon radial webs 12*b* and a cylindrical shaft 12*c* which is connected to the holding bush 12*a* by the webs 12*b*, so that several radial hollow chambers 12*d* in the handle 12 extending over the length of the handle are formed within the space between the bush 12*a* and the shaft 12*c*. The stick 1 is inserted with its lower end 1*c* in the holding bush 12*a* and releasably fixed by means of a transverse pin 13 which traverses the shaft 12*c*, two opposed webs 12*b*, 12*b* and centrally through the holding bush 12*a* and through the stick end 1*c* (FIG. 8). At the same time, the transverse pin 13 passes in fixing relationship through the bush-like locking member 10 of the release mechanism A2 as well as through a slot 14*a* of a piston 14 slidable in the locking member 10 and being part of a piston guide K of the release mechanism A, as will be described in more detail further-below. Hence, stick 1, handle 12 and locking member 10 are fixed by the transverse pin 13 to one another, and moreover the transverse pin 13 forms with its passage through the slot 14*a*° C. also a limit stop for the sliding movement of the piston 14 in the cavity 10*a* of the locking member 10.

A further cylindrical cavity 12*e* in the handle 12 extends from the stick end 1*c* or a flange 10*c* of the locking member 10 abutting against the stick end 1*c*, to the bottom 12*f* of the handle 12. The bottom 12*f* is formed by a cover 12*g* which is detachably clipped by a clip connection 12*h* onto the shaft 12*c* so that the cavity 12*e* and the hollow chambers 12*d* and the mechanisms accommodated therein are easily accessible after release of the cover 12*g* for allowing assembly and repair. The upper end of the handle shaft 12*i* is open to allow the runner 5 to move in and out.

The bush-like locking member 10 of the release mechanism A2 is inserted loosely and detachably in the stick end 1*c* and fixed, as described above. With its upper edge, the locking member 10 forms the stick-side stop 1*b* for the compression spring F1 and extends toward the lower end 1*c* of the stick 1 for support thereon by the flange 10*c*. Thus, the locking member 10 can easily be installed or exchanged by insertion during assembly and repair, with precise matching of the necessary coincidence positions of its ring shoulder 10*b* relative to the spring catch 9 and its attachment hole on the transverse pin 13. The same also applies to the other mechanism accommodated in the handle 12.

Unlocking of the spring catch 9 for triggering the closing operation of the umbrella is effected by a release slider in the form of a hollow cylinder 15 which is slidable in the cavity

Figure 4:
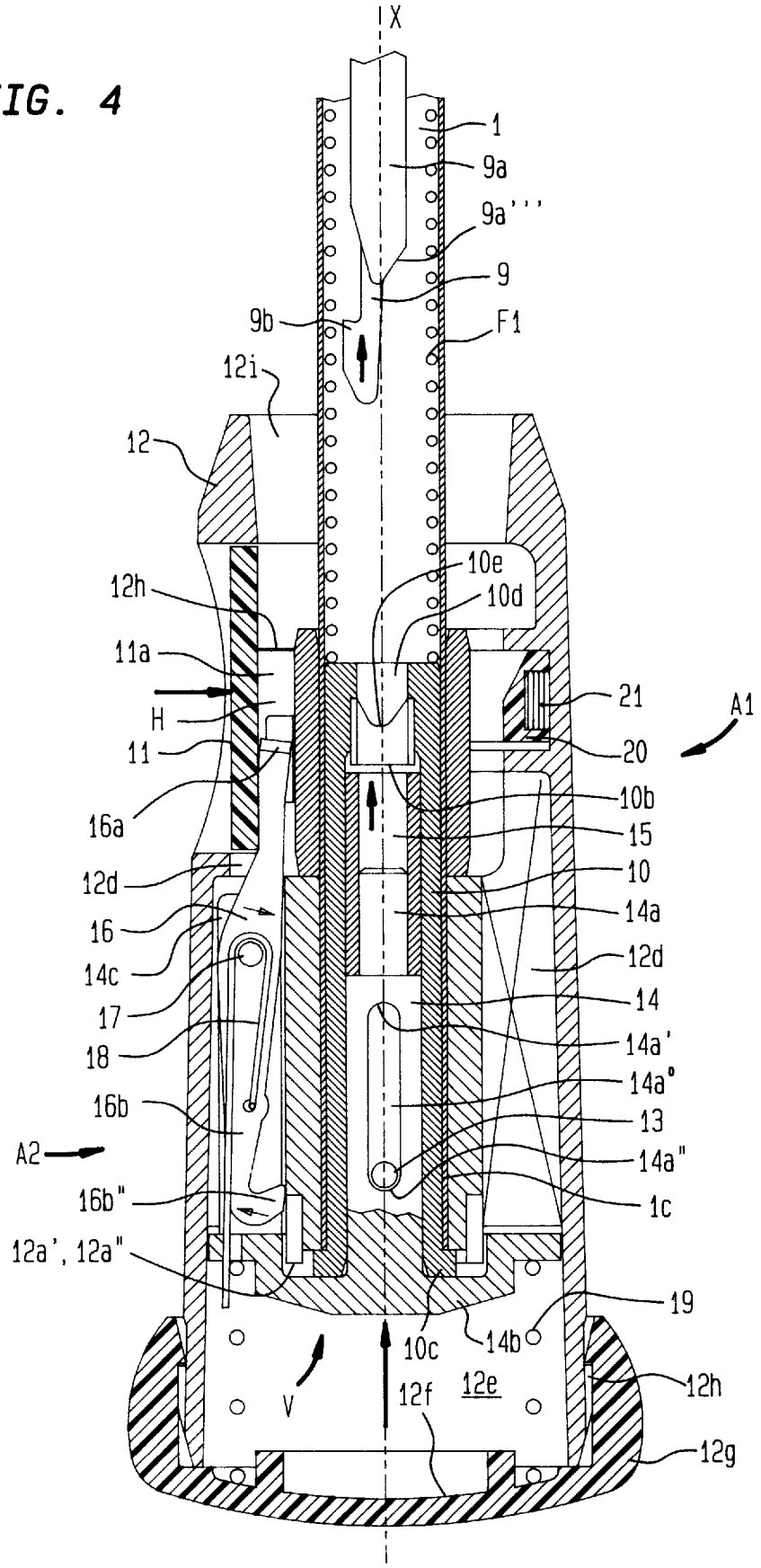
FIG. 4 shows an enlarged longitudinal sectional view of the handle region, after the closing process has been triggered.

10*a* of the locking member 10 and which in the course of an upward sliding movement of the piston guide K slides over the hooked end 9*b* of the catch 9 to disengage the catch 9 from behind the ring shoulder 10*b* of the locking member 10 (FIGS. 4, 5). The hollow cylinder 15 is formed integrally with the piston 14 already described, or fixed to a pin 14*a* thereof. The piston 14 forms part of the piston guide K which can slide up and down by means of the pin and slot guide formed by the transverse pin 13 and the slot 14*a*° C. within the locking member 10 to the extent of the length of the slot 14*a* within a certain sliding limit, with the upper end 14*a'* of the slot 14*a* providing the outermost sliding limit of the piston guide K out of the locking member 10, and the lower end 14*a"* of the slot 14*a* providing the outermost sliding limit into the locking member 10. The piston 14 is secured to or formed integrally with a plate-shaped disk 14*b*. Projecting outwards from the disk 14*b* in parallel disposition to the piston 14 is an arm 14*c* such as to extend parallel to the wall of the handle shaft 12*c* and to freely move into one of the hollow chambers 12*d* of the handle 12, with the arm 14*c* bearing with its upper edge 14*c in force-locking engagement upon the runner 5 (FIGS. 1, 2). Mounted on the arm 14***c* is a double-armed locking catch 16 which is pivotable about an axis 17 and held by a torsion spring 18 in the closed and shortened state of the umbrella (FIGS. 1, 2), with one edge 16*b'* of the lower lever arm 16*b* abutting against the cylindrical outer surface of the holding bush 12*a*. The lower lever arm 16*b* is provided with a hooked end 16*b"* for engagement of the lower edge 12*a"* or a stop ring 12*a'* of the holding bush 12*a* mounted on the lower edge 12*a"* in the position ready for release for effecting the closing operation, as shown in FIG. 3. With its upper lever arm 16*a*, the locking catch 16 cooperates with the control button 11 as soon as the catch 16 is moved by the piston guide K into the travel path H of the button 11 and can be engaged by the button 11, with the lever arm 16*a* with the hooked end 16*b"* becomes disengaged from the lower edge 12*a"* or the stop ring 12*a'*. Sliding of the locking catch 16 into the travel path H of the control button 11 is effected by the spring force exerted by a compression spring 19 which extends between the plate-shaped disk 14*b* and the bottom 12*f* of the handle cover 12*g*. In this way, the piston guide K of the locking catch 16 and unlocking hollow cylinder 15 is guided centrally in the stick axis X within the limit of the pin and slot guide 13, 14*a*, with a direction of sliding towards the end of the handle 12 under the action of the runner 5 and in the opposite direction under the action of the spring 19 towards the control button 11 in the required non-rotatable alignment of the arm 14*c* and the locking catch 16 with respect to its entry into the travel path H of the control button 11. Apart from this non-rotatable stroke, there is also in particular a corresponding stroke in the same direction of components 14, 15, 16, 17, 18 of the release mechanism A2 and of the unlocking system associated with it in a structural unit as a sliding unit (FIGS. 2, 3, 4, 5). This structural and sliding unit V is also designed and composed of simple robust components in such a way that it ensures high operational reliability and can be installed with few manipulations through insertion and is equally easy to dismantle again and capable of being exchanged after removal of the handle cover 12*g* from the handle shaft 12*c* and release of the transverse pin 13 (FIGS. 4, 5). Insertion of the structural and sliding unit V can also be limited, instead of the slot stop 14*a"*, by the fact that the disk 14*b* directly strikes the flange 10*c* of the locking member 10.

The control button 11 serves not only to activate the release mechanism A2 for effecting the closing operation, but also to activate the release mechanism A1 for effecting the opening operation. The control button 11 preferably forms an integral structural unit with the release mechanism A1 and its unlocking system, and is slidable transversely to the stick 1 in a groove 12*h* by means of a slider 11*a* in a cavity of the umbrella handle 12 which cavity forms the travel path H. The slider 11*a* surrounds the stick 1 in the form of an oval ring so as to pass all-round the stick 1 at sufficient sliding play and be able to slide the button 11 from its neutral position into its release positions for the opening and closing operations against the action of a spring 20 holding the slider 11*a* in the initial position. Upon opening of the umbrella, the button 11 disengages a locking bar 21 formed on the slider 11*a* from a latch opening 5*a* of the canopy opening runner 5, so that the stick 1 tensioned by the tackle S is released for telescopic extension, thereby effecting a simultaneous opening of the canopy D (FIGS. 2, 5). When the umbrella is intended to be closed, the button 11 is pushed again to unlatch the locking catch 16 against the action of the torsion spring 18 out of its locking position (FIG. 3) from the lower edge 12*a"* or stop ring 12*a'*, so that the piston guide K under the action of the spring 19 slides the release slider 15 over the hooked end 9*b* and thus disengages the resilient catch 9 from the ring shoulder 10*b* and, at the same time, effects a release of the tackle S in the direction of canopy closing under the action of the springs F2.

The main functions of the umbrella are accordingly determined by a) the automatic opening operation of the canopy D under the action of the spring mechanism F1 and simultaneous extension of the telescope stick 1 and tensioning of the closing springs F2, b) the subsequent automatic closing operation of the canopy D under the action of the closing springs F2, and C) the subsequent manual shortening of the umbrella to pocket size by pushing the telescope stick 1 together and simultaneous tensioning the opening spring F1.

During the opening operation, triggered by pressing the control button 11, the locking bar 21 disengages from the canopy opening runner 5 so that the runner 5 is moved upwards into the position shown in FIG. 6 by the tackle S to extend the telescopic stick 1, thereby opening the canopy D. As the tackle S is fixed in the locking member 10, the rope S' runs over the pulley 7 on the runner 5, the telescopic envelope TK opens out correspondingly and the canopy closing springs F2 are tensioned. At the same time, the runner 5 is released by the arm 14*c* so that the sliding unit comprised of components 14 to 18 slides with the release slider 15 and the locking catch 16 under the action at the spring 19 from the position according to FIG. 2 into the position shown in FIG. 3, with the locking catch 16 entering with its lever arm 16*a* in the travel path H of the control button 11 while still being hooked with its other lever arm 16*b* on the stop 12*a'*or 12*a"*, and the release slider 15 is positioned immediately adjacent the hooked end 9*b* of the resilient catch 9. The tension compensation device Z of the tackle S is now tensioned (FIG. 11).

The closing operation of the canopy D is also triggered by pushing the control button 11 which causes the locking catch 16 to pivot and disengage from the stop 12*a'*or 12*a"* against the action of the torsion spring 18 so that the sliding unit with the release slider 15 and the locking catch 16 is shifted further upwards by the action of the spring 19 into the position shown in FIG. 4 until the lower edge 14*a"* of the slot 14*a* strikes the transverse pin 13, with the release slider

15 moving over the hooked end 9*b* to disengage the hooked end 9*b* in a radial spring centering movement from the ring shoulder 10*b* of the locking member 10. Thus, the tackle S is now able to pull the spring catch 9 upwards on the push rod 8, under the action of the canopy closing springs F2, with the rope S' running back over the pulleys 6, 7, and simultaneous downward travel of the runner 5 and collapse of the canopy D. The tension compensation device Z is now free as a result of the fully extended stick. 1 (FIG. 10). Subsequently, the stick 1 is manually pushed together by grabbing the umbrella with both hands at the handle end 12*g* and crown 4 until the runner 5 with a bush 5*b* enters a complementary receiving opening 12*i* of the handle 12 and impacts on the arm 14*c* of the sliding unit with the release mechanism A2 and the release slider 15 and slides into the neutral position, shown in FIGS. 1 and 2. In this neutral position, the locking bar 21 engages the latch opening 5*a* of the runner 5 to thereby lock the canopy opening mechanism together with the tensioned stick 1 to occupy the initial position shown in FIG. 1, with the tackle S being relaxed again at the tension compensation device Z (FIG. 10). The pulley 7 is rolled down the rope S' again. The tension compensation device Z is now positioned immediately adjacent the pulley 6 mounted on the crown 4 due to longitudinal adjustment of the push rod 8 and its locking components 9, 10 in relation to the shortened length of the stick 1, and the envelope TK is pulled shut again. The opening spring F1 is tensioned again, while the closing springs F2 of are relieved. The canopy covering 3 is preferably retracted in the canopy rod assembly without creasing.

While the invention has been illustrated and described as embodied in a self-opening and self-closing collapsible umbrella, it is not intended to be limited to the details shown since various modifications and structural changes may be made without departing in any way from the spirit of the present invention.

What is claimed as new and desired to be protected by Letters Patent is set forth in the appended claims:

What is claimed is:

1. An automatic, collapsible umbrella; comprising:

a handle;

a canopy assembly;

an elongated telescopic stick defining a longitudinal axis and extending between the handle and the canopy assembly;

a runner traveling along the stick;

an opening spring mechanism accommodated in the stick for extending the stick and opening the canopy assembly by energy stored in the opening spring mechanism;

a first release mechanism accommodated in the handle for releasing the stored energy in the opening spring;

a closing spring mechanism integrated in the canopy assembly and tensioned during release of the stored energy of the opening spring mechanism to thereby store energy releasable for closing the canopy assembly;

a second release mechanism for releasing the stored energy in the closing spring mechanism, said second release mechanism including a locking member accommodated inside of and secured to the stick, a first catch extending axially in the stick and adapted for engagement with the locking member, a release member extending axially in the stick and slidable in axial direction for interaction with the first catch, and a second catch disposed outside of the stick and operatively connected to the release member for movement in a direction parallel thereto;

a tackle extending between the runner and the first catch; and a control button provided in the handle for so operating the first and second release mechanisms that the release member and the second catch are movable into a release position with respect to the first catch and the control button in direction toward the first catch when the stick is extended, and into a neutral position in direction away from the first catch when the stick is retracted.

2. The umbrella of claim 1 wherein the control button is slidably guided in the handle, said locking member having a tubular configuration with a cavity and being so arranged within the stick coaxial to the longitudinal axis as to be supported by the stick, said release member and said second catch forming a structural unit, with the release member being guided in the cavity of the locking member, spring-biased in direction of the first catch and including a lateral arm resting on the runner when the umbrella is closed, said second catch being swingably mounted to the lateral arm about a pivot axis and formed as a bidirectional lever having a first lever arm for engagement by the control button during closing operation, and a second lever arm for securing the release member in place in the neutral position at a distance to the first catch so that during opening operation, the release member is held in the neutral position while the first lever arm is moved into a travel path of the control button, and during closing operation a subsequent depression of the control button effects a disengagement of the second catch and an engagement of the release member with the first catch to disengage the first catch from the locking member, whereby a shortening of the stick at relieved closing spring mechanism results in a tensioning of the opening spring and a latching of the first catch onto the locking member.

3. The umbrella of claim 1 wherein the first release mechanism interacts with the runner.

4. The umbrella of claim 1, and further comprising a holding bush connected to the handle and encompassing the stick, said second catch having one hooked end for cooperation with a stop formed on an underside of the holding bush.

5. The umbrella of claim 4, and further comprising a rod connecting the rope to the first catch, said first catch being so secured to the rod as to be resilient in a radial direction, with the hooked end of the second catch automatically latching on the locking member when shortening the stick.

6. The umbrella of claim 5 wherein the stick has a handle-proximate end and a handle-distant end, said first catch being mounted with radial play in a U-shaped hollow section mounted to the rod, with the locking member being formed as a bush inserted in the handle-proximate end of the stick and being formed with a central stop ring for engagement by the hooked end of the first catch.

7. The umbrella of claim 6 wherein the hollow section has a pointed end for penetration in an entrance hole of the locking member during latching of the first catch, and is supported in the entrance hole by a slope complementing the pointed end of the hollow section as soon as the hooked end of the first catch engages behind the stop ring.

8. The umbrellas of claim 1 wherein the stick has a handle-proximate end and a handle-distant end, and further comprising a crown placed over the handle-distant end of the stick, said tackle including a rope secured to the runner, optionally via a pulley connected to the crown.

9. The umbrella of claim 8, and further comprising a tension compensating device arranged in the tackle and including a piston-cylinder arrangement including a sleeve forming the cylinder and a spring-biased piston bush guided in the sleeve.

10. The umbrella of claim 9, and further comprising a rod connecting the rope to the first catch, said tension compensating device being positioned adjacent the pulley on the crown within the stick between the rope and the rod when the umbrella is closed and the stick is shortened.

11. The umbrella of claim 1 wherein the release member is formed by a piston slidably received in a cavity of the locking member and a hollow cylinder secured to the piston and facing the first catch.

12. The umbrella of claim 11 wherein the release member includes a lateral arm resting on the runner when the umbrella is closed, said second release mechanism including a transverse pin secured to the handle, said piston having a slot for receiving the transverse pin and having a hollow-cylinder-distant end which is supported by a plate-shaped disk and biased by a compression spring extending between the handle and the disk, with the lateral arm being secured to the disk and extending in a cavity of the handle.

13. The umbrella of claim 12, and further comprising a holding bush connected to the handle and encompassing the stick, said handle including a handle shaft and a cover detachably clipped on the handle shaft, with a cylindrical cavity being formed between the cover and the holding bush to provide a space for arrangement and displacement of the disk and the compression spring.

14. The umbrella of claim 12 wherein the transverse pin connects the stick with the locking member as well as with the handle.

15. The umbrella of claim 1 wherein the opening spring mechanism includes a compression spring.

16. The umbrella of claim 1 wherein the closing spring mechanism includes a plurality of tension springs. a control button provided in the handle for so operating the first and second release mechanisms that an initial depression of the control button causes the first release mechanism to release the runner, and a subsequent depression of the control button causes the second release mechanism to disengage the second catch and allows the release member to move from a neutral position to an operative position in which the first catch is disengaged from the locking member.

17. An automatic collapsible umbrella; comprising:

a handle;

a canopy assembly;

an elongated telescopic stick extending between the handle and the canopy assembly;

a runner traveling along the stick;

an opening spring mechanism accommodated in the stick for storing energy releasable for extending the stick and opening the canopy assembly;

a first release mechanism accommodated in the handle for releasing the stored energy in the opening spring mechanism;

a closing spring mechanism integrated in the canopy assembly and tensioned during release of the stored energy of the opening spring mechanism to thereby store energy releasable for closing the canopy assembly;

a second release mechanism for releasing the stored energy in the closing spring mechanism, said second release mechanism including a locking member accommodated inside of and secured to the stick, a first catch extending axially in the stick and adapted for engagement with the locking member, a release member extending axially in the stick and slidable in axial direction for interaction with the first catch, and a second catch disposed outside of the stick and operatively connected to the release member for movement in a direction parallel thereto;

a tackle extending between the runner and the first catch; and a control button provided in the handle for so operating the first and second release mechanisms that an initial depression of the control button causes the first release mechanism to release the runner, and a subsequent depression of the control button causes the second release mechanism to disengage the second catch and allows the release member to move from a neutral position to an operative position in which the first catch is disengaged from the locking member.

* * * * *